US006401830B1

(12) United States Patent
Romanoff

(10) Patent No.: US 6,401,830 B1
(45) Date of Patent: Jun. 11, 2002

(54) FIRE EXTINGUISHING AGENT AND METHOD

(76) Inventor: David B. Romanoff, P.O. Box 38, New London, NH (US) 03257

( * ) Notice: Subject to any disclaimer, the term of this patent is extended or adjusted under 35 U.S.C. 154(b) by 0 days.

(21) Appl. No.: 09/718,207

(22) Filed: Nov. 21, 2000

(51) Int. Cl.[7] ..... A62C 2/00
(52) U.S. Cl. ..... 169/46; 169/47
(58) Field of Search ..... 169/43, 44, 45, 169/46, 47

(56) References Cited

U.S. PATENT DOCUMENTS 4,250,714 A * 2/1981 Covy ..... 169/45
4,378,920 A * 4/1983 Runnels et al. ..... 169/45
5,368,105 A * 11/1994 Chaiken et al. ..... 169/46

OTHER PUBLICATIONS

Simmonds, David, Clean Fire Extinguishing Agents—Part 2, Fire Surveyor, vol. 22, Part 6, Dec. 1993, pp. 27–31.
Riley, J. F., Clean Agent Fire Suppression and Life Safety Using Inert Gases, 4th International Conference on Offshore Loss Prevention—A Systematic Approach, Part 1, Aberdeen, UK, Mar. 1993, pp. 181–194.

* cited by examiner

*Primary Examiner*—Lisa A. Douglas
(74) *Attorney, Agent, or Firm*—Robert R. Deleault, Esq.; Mesmer & Deleault, PLLC

(57) ABSTRACT

A process for extinguishing a fire, using an inert gas in its liquid phase as the fire extinguishing agent. The extinguishing agent must be a clean agent so it must not be electrically conductive and it must not leave any post evaporation residue. The extinguishing agent possesses properties that make the agent the capable of extinguishing fires. Also, the process does not have any effects that are harmful to the environment.

7 Claims, No Drawings

FIRE EXTINGUISHING AGENT AND METHOD

BACKGROUND OF THE INVENTION

1. Field of the Invention

The present invention relates to the field of extinguishing fires. Particularly, the present invention relates to a method of extinguishing fires. More particularly, the present invention relates to a method of extinguishing fires using a clean fire extinguishing agent. More particularly, the present invention relates to a method of extinguishing fires that has no adverse effects on the environment and does not risk the health and safety of humans.

2. Description of the Prior Art

In order for a fire to occur there are four requirements that must be met. These requirements are (1) suitable fuel, which is any material that can be easily oxidized, (2) a suitable oxidizing agent, (3) a source of heat, and (4) a chemical chain reaction path. Considering these four requirements for a fire there are basically four ways to extinguish a fire. These four methods of extinguishing a fire are (1) to remove heat, (2) to separate the fuel from the oxidizer, (3) to dilute the fuel/oxidizer concentration, and (4) terminate the chemical chain reaction. There are different compounds that are used for each of these extinguishing methods. Water is used for heat removal. High expansion foam may be used for separating the fuel from the oxidizer. Halon can be used to terminate the chemical chain reaction. Finally, gaseous carbon dioxide ($CO_2$) or gaseous nitrogen ($N_2$) can be used to dilute the fuel/oxidizer concentration.

Fires and combustion occur not only in buildings and residences but also in the wild. Forest fires occur at a large rate in the United States. Recently, there have been over 300 forest fires recorded in the United States and the fires have spanned over 55,000 acres of land. Forest fires are extremely costly to extinguish using the present fire fighting methods. For instance, one fire that occurred in the Valley Complex of Montana required 4.9 million dollars to extinguish. The main concern of fire engineers has been to create a clean fire extinguishing agent that has sufficient fire suppression properties but does not have harmful effects to human health or the environment.

Several methods of extinguishing fires have been developed using various fire extinguishing agents. Halon 1301 has been relied on in recent years as a clean agent fire suppression medium that has no significant threat to life. The problem with Halon 1301 is that it is a chlorfluorocarbon and it is associated with the destruction of the ozone layer. There has been a recent urge to discover materials that have similar fire suppression properties to Halon just without the harmful environmental effects.

Several traditional agents are being used to replace the use of Halon 1301. Gaseous $CO_2$ is an example of such an agent because $CO_2$ has cooling and oxygen depleting properties. In enclosed areas, $CO_2$ safety features must be added to the system to prevent $CO_2$ discharge while an area is still occupied by people.

Another traditional method is to use wet systems like sprinklers. These wet systems are not very suitable for areas that contain electrical equipment. Another problem with wet systems is that long before there is enough heat to activate the wet system there will be a large amount of smoke accumulation and smoke will damage equipment in the area. There are two wet systems in particular that are being used in replace of Halon 1301.

The first of these two wet systems is a fine water spray system. There are various systems that are available and these systems vary in several aspects including water pressure and whether or not the water is pure or mixed with other elements. The water in these systems can also be de-ionized which will reduce the risk of electric shock and it can be used around electrical equipment. Unlike traditional wet systems, only a small amount of water is needed to put out a fire and because the water system is activated by smoke detectors. This minimizes the amount of damage caused by combustion emissions.

The second of the two wet systems is high expansion foam. The foam consists of masses of bubbles which cover a fire and prevent any air from fueling the fire. The heat from the fire causes the foam to vaporize the water content into steam. This process has the effect of absorbing heat. The steam and air that are now surrounding the fire has an oxygen content of only 7.5% which is not enough oxygen for combustion to occur. Finally, the bursting of the bubbles results in the contents of the bubbles being deposited on hot surfaces and in turn the bubbles cool down these hot surfaces.

Another alternative agent is HCFC Blend "A", or more commonly NAF S-III. This agent is a blend of HCFCs 22,123 and 124 and has a detoxifying agent added to it to minimize the amount of post combustion products. NAF S-III qualifies as a clean agent because it does not conduct electricity and it does not leave residue after evaporation. The problem with this material is that the production of HCFCs is scheduled to cease in 2030. Also, use controls are being installed to ensure that HCFCs are not used in place of environmentally sound alternatives.

Heptafluoropropane, or FM-200, is currently the only halocarbon with an ozone depleting potential of zero which can be used as a fire extinguishing agent. This agent does not conduct electricity and does not leave a residue after evaporation, so it is also a clean agent. FM-200 has been approved by the EPA for use in normally occupied spaces. One problem with this agent is that it can produce post combustion products in greater amounts than Halon when it comes into contact with flames or heat.

There are also several inert gas blends that are being used to extinguish fires. Two of these nitrogen based fire extinguishing agents are called INERGEN and Argonite. Both of these materials have fire extinguishing capabilities but do not harm the ozone layer at all. Inert gas blends are designed to reduce the level of oxygen in an environment from 21% to 14%. At 14% there is no longer enough oxygen to sustain combustion. Also, inert gas blends do not break down to produce harmful decomposition products while they are extinguishing a fire.

INERGEN contains 52% nitrogen, 40% argon and 8% $CO_2$. INERGEN can be used in normally occupied spaces and has completed fire extinguishing tests. When INERGEN is discharged it creates an oxygen deficient environment. INERGEN contains $CO_2$ to promote breathing characteristics. There is also no fear of toxicity from INERGEN.

Argonite does not contain any $CO_2$, just 50% nitrogen and 50% argon. There are indications that healthy people may be exposed to oxygen levels of 12 to 14% for short periods of time without having any effect on mental capacity. Therefore, the supporters of Argonite do not see any need for adding $CO_2$ to the mixture. Argonite is a colorless, odorless gas so an odorizer is sometimes added to alert personnel of a leakage or discharge.

When selecting a fire extinguishing system there are several factors to consider. One of these factors relates to the environment. There are many environmental aspects to consider and the agent that is chosen should minimize the amount of harm done to the environment.

Therefore, what is needed is a fire extinguishing agent that has the capabilities to suppress combustion. What is further needed is a fire extinguishing agent that does not conduct electricity and does not leave a residue after evaporation so it will be categorized as a clean agent. What is still further needed is a fire extinguishing agent that has minimal adverse effects on the environment and does not destroy the ozone layer. What is still further needed is a fire extinguishing agent that has no hazardous decomposition products and poses no threat to the safety and health of humans. Finally, what is still further needed is a fire extinguishing system that is both cost effective to initiate and to maintain.

SUMMARY OF THE INVENTION

It is an object of this present invention to provide a fire extinguishing agent that has sufficient fire suppression capabilities. It is a further object of this present invention to provide a fire extinguishing agent that does not conduct electricity or leave a post evaporation residue so that it will be categorized as a clean agent. It is still a further object of this present invention to provide a fire extinguishing agent that has minimal adverse effects on the environment and does not destroy the ozone layer. It is still a further object of this present invention to provide a fire extinguishing agent that has no hazardous decomposition products and poses no threat to the safety and health of people. Finally, it is still a further objective of this present invention to provide a fire extinguishing agent that is both cost effective to initiate and to maintain.

The present invention achieves these and other objectives by providing the specific properties and features that are required for a material to be classified as a fire extinguishing clean agent. Nitrogen is a clean agent because it does not conduct electricity and it does not leave post evaporation residue. Liquid nitrogen also has properties that make it capable of extinguishing fires. One method for extinguishing fires and suppressing combustion is to remove heat from the fire. This method of extinguishing fires is utilized when water is used as the extinguishing agent. Water, in its liquid phase, is in the temperature range of 32° F. (0° C.) and 212° F. (100° C.). Liquid nitrogen is at a much lower temperature range than water. The temperature range for nitrogen in its liquid phase is between −345.8° F. (−210° C.) and −320.4° F. (−195.8° C.). Liquid nitrogen, existing at a much lower temperature, will have the capability of removing heat from a fire and thus extinguishing it at a greater rate than a liquid like water. Further, as liquid nitrogen evaporates, it will also reduce the level of oxygen present at the fire/combustible material interface helping to oxygen-starve the fire.

In addition to being a clean agent with the capabilities of extinguishing fires, liquid nitrogen has other properties that are important to this process. Liquid nitrogen is a stable material that has no known incompatibilities with other materials. Also, liquid nitrogen has no hazardous decomposition products either. Therefore, the use of liquid nitrogen will not result in any problems when it reacts with other materials.

Liquid nitrogen is a safe material for both people and the environment. The use of liquid nitrogen is not harmful to the environment and it does not have the effect of deteriorating the ozone layer. Liquid nitrogen is virtually harmless to people as well. There are two things that can occur from an acute, single overexposure to liquid nitrogen. If there is skin contact, liquid nitrogen may cause frostbite. Also, nitrogen is an asphyxiant and inhalation can lead to headaches, dizziness, vomiting and unconsciousness. These effects can be easily remedied and are not a major concern. There are no effects from repeated overexposure to liquid nitrogen and there are no medical conditions that are aggravated by overexposure to liquid nitrogen. If the nitrogen is being used in a closed space it will result in an oxygen depleted environment, but this will not be a problem when liquid nitrogen is used to extinguish forest fires. Overall, there are no serious human health hazards resulting from use of liquid nitrogen.

Structural fires are most commonly extinguished with the use of water. Fire extinguishing crews generally extinguish fires by spraying the burning structure with water. When a fire is extinguished in this manner a considerable amount of water damage to the structure will occur because a great deal of water is required to extinguish a structural fire. The use of liquid nitrogen to extinguish a fire in these situations would significantly reduce the amount of damage done to the structure. After a fire has been extinguished using water some of the water will still remain on the structure and soak whatever is found in the structure. Because of liquid nitrogen's very low boiling point (−195.8° C.) compared to water's boiling point (100° C.), there will be little, if any, residual liquid nitrogen to cause damage to the structure and its contents when it is used to extinguish a fire.

There are many different types of fires that can be extinguished using liquid nitrogen. Forests and structures of all kinds including high rise buildings, airplanes, schools, offices, and hospitals can all be saved using liquid nitrogen. Liquid nitrogen can also be used on electrical fires because it is a clean agent so it does not conduct electricity. Liquid nitrogen can further be used to extinguish gasoline fires and chemical fires because it does not have any known incompatibilities with other known materials. Finally, it has been demonstrated that liquid nitrogen can be used to extinguish tire fires.

In use, the user will extinguish fires by directing the liquid nitrogen onto a fire in a manner similar to that used for water. Depending on the size of the fire, the amount of liquid nitrogen will vary. The liquid nitrogen will remove heat from the fire, lower the oxygen level at the fire/combustible material interface and, in a matter of seconds, the fire will be extinguished.

Additional advantages and embodiments of the present invention will be set forth in part in the detailed description that follows, and part will be apparent from the description, or may be learned by practice of the invention. It is understood that the foregoing general description and the following detailed description are exemplary and explanatory and are intended to provide further explanation on the invention as claimed.

DETAILED DESCRIPTION OF THE PREFERRED EMBODIMENT

The preferred embodiment of the present invention uses a liquid phase inert substance as the fire-extinguishing agent. The fire-extinguishing agent is preferably a substance that has a freezing point below 0° C. The material should have no known incompatibilities with other materials and no hazardous decomposition products. Liquid nitrogen has been found to have the properties required above for extinguishing fires of any kind. The temperature range for nitrogen in its liquid phase is −345.8° F. (−210° C.) and −320.4° F. (−195.8° C.). Also, liquid nitrogen is not harmful to the environment and does not have the effect of deteriorating the ozone layer.

The preferred embodiment of the present invention is illustrated in the following examples.

EXAMPLE 1

A shallow hole was dug and filled with paper and wood. The paper and wood were ignited and the fire was allowed to burn until the paper and wood were thoroughly burning. A small container of liquid nitrogen was obtained and liquid nitrogen was dripped over the fire. The fire was extinguished in a few seconds using only 6–8 ounces of liquid nitrogen.

EXAMPLE 2

A larger amount of paper and wood was used in this example. The materials were soaked in gasoline before igniting the paper and wood. The materials were set on fire and left to burn. Again a small container of liquid nitrogen was obtained and the liquid nitrogen was dripped over the fire. The fire was extinguished in a few seconds using only 6–8 ounces of liquid nitrogen.

EXAMPLE 3

Paper, wood, grease and part of a rubber tire were placed in the shallow hole of Example 1. Everything was soaked in gasoline and then set on fire. This resulted in a very hot, black, smoky fire. A larger container of liquid nitrogen than was used in the first two examples was obtained and the liquid nitrogen was dripped over the fire. The fire was extinguished in a few seconds. In this experiment less than a half of a gallon of liquid nitrogen was used.

EXAMPLE 4

The materials to be ignited were placed on a flat surface of ground instead of in a hole. This was done to see if there would be any differences or problems not encountered in the previous examples when extinguishing the fire. Paper, wood, rubber, and grease were soaked with a larger quantity of gasoline than was used in Example 3. The fire was ignited and was allowed to burn for a while. The resulting fire was larger and higher in temperature than the fire in any of the previous examples. The liquid nitrogen was again poured on the fire. The fire was completely out in seconds and again less than one half of a gallon of liquid nitrogen was used to extinguish the fire. As part of the experiment, there was an attempt to reignite the material but the attempt failed, i.e. it was not possible to reignite the materials.

It is obvious to those skilled in the art that any of the embodiments of the present invention would be used in a similar fashion. The present invention would be used in the same manner if the fire were structural, chemical, electrical or any other form.

Although the preferred embodiment of the present invention has been described herein, the above description is merely illustrative. Further modification of the invention herein disclosed will occur to those skilled in the art and all such modifications are deemed to be within the scope of the invention as defined by the appended claims.

What is claimed is:

1. A process for extinguishing a fire, said process comprising the steps of: obtaining a quantity of a clean fire extinguishing agent, wherein said agent is a single liquid phase molecular substance with a freezing point below 0° C.; and disposing a portion of said quantity of said clean fire extinguishing agent onto said fire.

2. The process of claim 1 wherein said obtaining step includes obtaining a quantity of a liquid phase inert gas.

3. The process of claim 2 wherein said liquid phase inert gas is selected from the group consisting of nitrogen and carbon dioxide.

4. The process of claim 1 wherein said disposing step includes directing a quantity of liquid phase inert gas onto said fire.

5. The process of claim 2 wherein said liquid phase inert gas is liquid nitrogen.

6. The process of claim 1 wherein said obtaining step includes obtaining a quantity of liquid nitrogen.

7. A method of using liquid inert gas as a fire extinguishing agent comprising the steps of:

obtaining a quantity of liquid nitrogen; and disposing of said quantity of said liquid nitrogen onto a fire to extinguish said fire.

* * * * *